US006123149A

United States Patent [19]

McKinzie et al.

[11] Patent Number: 6,123,149

[45] Date of Patent: *Sep. 26, 2000

[54] DUAL INJECTION AND LIFTING SYSTEM USING AN ELECTRICAL SUBMERSIBLE PROGRESSIVE CAVITY PUMP AND AN ELECTRICAL SUBMERSIBLE PUMP

[75] Inventors: Howard L. McKinzie, Sugar Land, Tex.; Lon A. Stuebinger, Littleton, Colo.; Kevin R. Bowlin, Jakarta, Singapore

[73] Assignee: Texaco Inc., White Plains, N.Y.

[ * ] Notice: This patent is subject to a terminal disclaimer.

[21] Appl. No.: 09/154,139

[22] Filed: Sep. 17, 1998

Related U.S. Application Data

[60] Provisional application No. 60/059,732, Sep. 23, 1997.

[51] Int. Cl.[7] ..... E21B 43/40

[52] U.S. Cl. ..... 166/266; 166/68.5; 166/106; 166/369

[58] Field of Search ..... 166/265, 266, 166/369, 106, 65.1, 68.5, 54.1, 313

[56] References Cited

U.S. PATENT DOCUMENTS

| | | |
|---|---|---|
| 2,214,064 | 9/1940 | Niles . |
| 2,281,801 | 5/1942 | Reynolds et al. . |
| 2,910,002 | 10/1959 | Morgan . |
| 2,986,215 | 5/1961 | Barr . |
| 3,167,125 | 1/1965 | Bryan . |
| 3,333,638 | 8/1967 | Bishop . |
| 3,363,692 | 1/1968 | Bishop . |
| 3,677,665 | 7/1972 | Corkill . |
| 3,977,469 | 8/1976 | Broussard et al. . |
| 4,047,539 | 9/1977 | Kruka . |
| 4,241,787 | 12/1980 | Price . |
| 4,251,191 | 2/1981 | Gass et al. . |
| 4,295,795 | 10/1981 | Gass et al. . |
| 4,296,810 | 10/1981 | Price . |
| 4,480,686 | 11/1984 | Coussan . |
| 4,545,731 | 10/1985 | Canalizo et al. . |
| 4,745,937 | 5/1988 | Zagustin et al. . |
| 4,749,034 | 6/1988 | Vandevier et al. . |
| 4,753,261 | 6/1988 | Zagustin et al. . |
| 4,766,957 | 8/1988 | McIntyre . |
| 4,773,834 | 9/1988 | Saruwatari . |
| 4,793,408 | 12/1988 | Miffre . |
| 4,818,197 | 4/1989 | Mueller . |
| 4,832,127 | 5/1989 | Thomas et al. . |
| 5,159,977 | 11/1992 | Zabaras . |
| 5,176,216 | 1/1993 | Slater et al. . |
| 5,335,732 | 8/1994 | McIntyre . |
| 5,425,416 | 6/1995 | Hammeke et al. . |
| 5,497,832 | 3/1996 | Stuebinger et al. . |

(List continued on next page.)

FOREIGN PATENT DOCUMENTS

| | | |
|---|---|---|
| 2 194 572 | 3/1988 | United Kingdom . |
| 2 248 462 | 4/1992 | United Kingdom . |
| WO 97/25150 | 7/1997 | WIPO . |

OTHER PUBLICATIONS

Miller, *The American Oil & Gas Reporter,* Jan., 1997, pp. 76–80.

Miller, *The American Oil & Gas Reporter,* Mar., 1997, p. 106–109.

(List continued on next page.)

*Primary Examiner*—David Bagnell
*Assistant Examiner*—Zakiya Walker
*Attorney, Agent, or Firm*—Harold J. Delhommer; Howrey Simon Arnold & White

[57] ABSTRACT

The present invention relates to an apparatus and method for selectively lifting produced fluids, including produced hydrocarbons and a portion of produced water, to a ground surface while injecting the remaining produced water into an injection zone subsurface in a subterranean well. The invention preferably utilizes an electrical submersible progressive cavity pump (ESPCP) in conjunction with an electrical submersible pump (ESP) in order to carry out the dual injection and lifting steps. Further, this apparatus and method make it possible to produce hydrocarbons from oil wells in a manner that poses less risk and disturbance to the environment.

23 Claims, 4 Drawing Sheets

U.S. PATENT DOCUMENTS

| | | | |
|---|---|---|---|
| 5,562,405 | 10/1996 | Ryall . | |
| 5,579,838 | 12/1996 | Michael . | |
| 5,697,448 | 12/1997 | Johnson . | |
| 5,755,554 | 5/1998 | Ryall . | |
| 5,979,559 | 11/1999 | Kennedy | 166/369 |

OTHER PUBLICATIONS

Stuebinger et al., SPE Paper No. 38790, *Society of Petroleum Engineers,* 1997, pp. 1–10.

MBC Inc., Introducing a Concurrent Process of Gas Production/Water Disposal, 10 pages.

Reda, Downhole Dewatering Systems, 6 pages, 1997.

Chriscor, a division of IPEC Ltd., Chriscor Downhole Water Injection Tool, 3 pages.

T. Kjos et al., SPE Paper No. 030518, Society of Petroleum Engineers, 1995, pp. 689–701.

B.R. Peachey et al., Downhole Oil/Water Separation Moves Into High Gear, 37 Journal of Canadian Petroleum Technology, Jul. 1998, pp. 34–41.

James F. Lea et al., What's new in artificial lift; Part 2; advances in electrical submersible pumping equipment and instrumentation/control, plus other new artificial lift developments, World Oil, Apr., 1996, pp. 47–56.

DUAL INJECTION AND LIFTING SYSTEM USING AN ELECTRICAL SUBMERSIBLE PROGRESSIVE CAVITY PUMP AND AN ELECTRICAL SUBMERSIBLE PUMP

The present application claims priority under 35 U.S.C. § 119(e) to provisional application 60/059,732, filed Sep. 23, 1997, the entirety of which is incorporated herein by reference.

BACKGROUND OF THE INVENTION

1. Field of the Invention

The present invention relates to an apparatus and method for improving the economics of hydrocarbon production from a producing well. In particular, the present invention relates to an apparatus and method for selectively lifting produced fluid, including produced hydrocarbons and a portion of produced water, to the ground surface and for injecting the remaining produced water, subsurface, in a subterranean well.

2. Related Art

Conventional hydrocarbon production wells have been constructed in subterranean strata that yield both hydrocarbons, such as oil and gas, and an undesired amount of water. These wells are usually lined with heavy steel pipe called "casing" which is cemented in place so that fluids cannot escape or flow along the space between the casing and the well bore wall. In some wells, large amounts of water are produced along with the hydrocarbons from the onset of production. Alternatively, in other wells, relatively large amounts of water can be produced later during the life of the well.

The production of excess water to the ground surface results in associated costs in both the energy to lift, or "produce," as well as the subsequent handling of the excess produced water after it has arrived at the surface. Moreover, the produced water must be disposed of after it has been brought to the ground surface. Surface handling of excess water, in addition, creates risks of environmental pollution from such incidents as broken lines, spills, overflow of tanks, and other occurrences. Further, the facilities, lines, and wells required to handle excess water disturb the environment by virtue of their construction and presence. Accordingly, many oil production fields and wells often rapidly become uneconomic to produce hydrocarbons because of excessive water production.

Various apparatuses and methods have been proposed to overcome the problems associated with excess water production and the aforementioned problems associated with lifting, or producing, this water to the ground surface. Several approaches have been used to produce excess water to the ground surface or to avoid producing the excess water to the ground surface by shutting off the water at the entry into the wellbore. Among these means are: installing larger pumps to pump the water to the ground surface; shutting off the water by injecting gels or resins into the formation; and installing mechanical means in the well to interrupt the flow of water into the wellbore. These approaches, however, have not recognized that effective removal of water from oil or gas wells can be accomplished by transferring the accumulated water subsurface to a water-absorbing injection formation.

An evolving approach to the problem of excess water production is to take advantage of the downhole gravity segregation of produced hydrocarbons and produced water in the wellbore. The excess produced water is then conveyed into an injection formation of the subterranean strata while, for example, the oil and a small portion of the produced water that has not fully segregated from the oil are produced, or "lifted," to the ground surface. Such an approach has generally been referred to as an "in-situ" injection method. The conveyance downhole of produced water, without having lifted a majority or all of it to the ground surface, can substantially improve lease revenues or reduce lease operating expenses and investments, thereby extending the economic life of entire fields.

Devices or systems that lift and/or flow hydrocarbons and a portion of the water to the ground surface, while simultaneously injecting the water which has been separated downhole may be referred to by those persons having ordinary skill in the art as "Dual Injection and Lifting Systems (DIALS)," or alternatively, as "Downhole Oil Water Separation (DOWS)."

Generally, such methods have required the availability of a suitable injection formation, either below or above the production zone, with sufficient permeability to permit injection of the excess water into the injection formation. In addition, these in-situ methods have generally employed pumps of the same type (e.g., dual rod pumps). These pump combinations have generally been powered by the same prime mover or drive, such as a conventional pump drive located at the ground surface.

Conventional coupled systems which have been driven by the same prime mover have presented numerous problems with regard to production flexibility in order to accommodate changing reservoir conditions. This is so because it has not been feasible or simple enough to individually control the amount of fluids being lifted to the ground surface and the amount of water being injected by the coupled pumps. For example, the output of the lifting pump in a coupled system, such as a dual-rod pump, may not be variably reduced during production and the output of the injection pump may not be variably increased during production. Such flexibility is needed, for instance, when the well volume remains constant during production but the percentage of oil production decreases with time.

One example of a conventional production apparatus of the coupled in-situ type is a Dual Action Pumping System ("DAPS") that produces oil and a portion of the water from a casing/tubing annulus on the upstroke of the pump, injects water on the downstroke, and uses the gravity segregation of the oil and water within the annulus. Such an apparatus is shown in U.S. Pat. No. 5,497,832, also assigned to the assignee of the present application, the entirety of which is incorporated herein by reference.

Tests of this technology in a number of different wells have shown that gravity segregation of oil and water enable a dual-ported, dual-plunger rod pump to selectively lift produced fluids, including produced hydrocarbons and a portion of produced water, while separating and injecting the remaining produced water into an injection zone within the subterranean strata.

The DAPS apparatus, however, does not solve all of the problems associated with excess water production or changing water production within the subterranean reservoir. Very often, the use of two pumps of the same type (e.g., dual rod pumps) may limit the ability of the pumping system to minimize the amount of water lifted to the ground surface. For example, a system, such as DAPS, using a 1.75" diameter rod pump and a 1.5" diameter rod pump will generally lift approximately 18% of the total produced fluids to the ground surface even though the well produces only approximately 5% oil. Further, in coupled systems (i.e., pumps sharing the same prime mover), as noted above, the ability of the systems to adjust to changing water cut production is limited. For example, the various parts of the pump assemblies of coupled systems cannot economically be changed frequently enough to meet changing reservoir conditions.

In a further example of the conventional in-situ approach, coupled rod pumps are used for separating and producing oil from water in a well, while simultaneously injecting the water into the producing formation or into an injection formation below the producing formation. Such an apparatus is shown in U.S. Pat. No. 5,697,448. The apparatus employs three spaced packers (upper, middle, and lower). An oil pump is located between the upper and middle packers, and a water pump is located between the middle and lower packers. Produced oil and water are accumulated between the upper and middle packers. The oil is delivered through an opening into the oil pump and fills a cylinder associated with the oil pump. Produced water is allowed to drain through additional passages into the water pump cylinder where it accumulates for injection. Selective pumping of the oil on the upstroke of the pump and the water on the downstroke of the pump is effected by a set of check valves associated with both the oil and water pumps. Such an apparatus, however, is not an optimal solution to the problems associated with changing water and oil production presented by conventional coupled systems. For example, the apparatus does not provide the flexibility needed to vary the percentage of total reservoir output that is lifted or brought to the ground surface without substantial modifications to the system.

In another example of an in-situ type apparatus, a formation injection tool, mounted to a bottom-hole tubing pump, carries out underground separation and down-bore in-situ transport and injection of the undesired fluids into an injection formation in the production well. Such an apparatus is shown in U.S. Pat. No. 5,425,416. As with the apparatus shown in U.S. Pat. No. 5,697,448, this system does not provide the flexibility needed to quickly and inexpensively change the proportion of fluids lifted to the ground surface as conditions within the subterranean producing strata change.

Moreover, conventional systems such as those described above have failed to provide a simple and effective method for handling high viscosity oils or solids, such as sand, which are present in many production wells. In addition, many wells have become inoperative due to the inability of conventional systems to handle crude oil and gas mixtures or shear sensitive fluids. Conventional wells generally have also not been able to compensate for changes in pressure, such as those that may be caused by gas bubbles.

Thus, there is a need in the art for an apparatus and method that substantially obviates one or more of the limitations and disadvantages of conventional pumping systems. Particularly, there is a need for a system for lifting produced oil and a portion of the produced water to the ground surface, while injecting the remainder of the produced water into an injection formation. There is a particular need for uncoupled systems which have the flexibility to vary the proportions of fluids lifted to the ground surface to the amount of water injected subsurface within the subterranean strata. There is also a need for such systems to be able to handle a variety of conditions within the producing reservoir.

SUMMARY OF THE INVENTION

The present invention solves the problems with, and overcomes the disadvantages of, conventional coupled systems for lifting produced hydrocarbons and a portion of the produced water to the ground surface following gravity segregation, and for injecting, without lifting to the ground surface, the remaining produced water into an injection zone.

The present invention relates to an apparatus for selectively lifting produced fluids, including produced hydrocarbons and a portion of produced water, to a ground surface and injecting, without lifting to the ground surface, the remaining produced water below the ground surface. The apparatus includes a casing having two spaced intervals. The casing extends from the ground surface downwardly such that a first of the two spaced intervals communicates with a producing zone and a second of the two spaced intervals communicates with an injection zone.

The apparatus further includes an electrical submersible progressive cavity pump and an electrical submersible pump disposed in the casing. A packer is also included. The packer is disposed within the casing between the first of the two spaced intervals and the second of the two spaced intervals. The casing and the packer are configured to permit the produced fluids to collect above the packer whereby the produced hydrocarbons and produced water segregate by gravity.

The apparatus also includes a first inlet for permitting the segregated produced hydrocarbons and portion of the produced water to enter one of the electrical submersible progressive cavity pump and the electrical submersible pump. A second inlet is included for permitting the segregated produced water to enter the other of the electrical submersible progressive cavity pump and the electrical submersible pump.

In a further aspect of the invention, a downhole oil and water separation system is provided for conducting produced fluids, including produced hydrocarbons and a portion of produced water, to a ground surface and injecting, without conducting to the ground surface, the remaining produced water below the ground surface. The system includes a casing having two spaced intervals. The casing extends from the ground surface downwardly such that a first of the two spaced intervals communicates with a producing zone and a second of the two spaced intervals communicates with an injection zone.

The system further includes an electrical submersible progressive cavity pump and an electrical submersible pump disposed in the casing. The electrical submersible progressive cavity pump is not drivingly coupled to the electrical submersible pump. A packer is disposed within the casing between the first of the two spaced intervals and the second of the two spaced intervals. The casing and the packer are configured to permit the produced fluids to collect above the packer whereby the produced hydrocarbons and produced water segregate by gravity.

In one aspect of the system, a first inlet permits segregated produced hydrocarbons and portion of the produced water to enter the electrical submersible progressive cavity pump, and a second inlet permits the segregated produced water to enter the electrical submersible pump.

In an alternate aspect of the system, the first inlet permits segregated produced hydrocarbons and portion of the produced water to enter the electrical submersible pump, and the second inlet permits the segregated produced water to enter the electrical submersible progressive cavity pump.

In another aspect, the present invention relates to a method for selectively lifting fluids, including produced hydrocarbons and a portion of produced water from a subterranean well, to a ground surface and injecting, without lifting to the ground surface, the remaining produced water, subsurface, the subterranean well traversing a producing zone and an injection zone.

The method includes allowing produced water and produced hydrocarbons to collect and to segregate above a packer disposed in a casing in the subterranean well. In addition, the method includes controlling one of an electrical submersible progressive cavity pump and electrical submersible pump to lift the segregated produced hydrocarbons and a small portion of the produced water to the ground surface. The method also includes independently controlling the other of the electrical submersible progressive cavity pump and electrical submersible pump to inject the segregated produced water into the injection zone.

Features and Advantages

The present invention represents a different approach to the aforementioned problems of conventional systems. The present invention represents an improvement over such systems, and is particularly suitable for use in loosely consolidated formations where solids production can be a problem, or where gas and condensate production accompanies the crude oil production. The present invention also utilizes smaller surface profiles and weight-bearing requirements which may be important in such applications as offshore platforms.

The present invention also provides for uncoupled pump systems which are separately and independently controlled by, and driven by, individual drive units, or separately driven and independently controlled by the same drive unit. As such, the present invention provides a simple, expedient, and flexible method for controlling the amount of hydrocarbons and water lifted to the ground surface, while at the same time injecting excess produced water into an injection zone. The present invention provides such flexibility while retaining the advantages of electrical submersible progressive cavity pumps and electrical submersible pumps.

The present invention also is advantageous over purely rod-driven lift systems because it can handle larger volumes of produced fluids. Moreover, the rates for lifting hydrocarbons to the ground surface and for injecting water into a disposal zone may be separately and independently varied and controlled.

The present invention may also be used in oil-producing wells to reduce lease costs that are directly associated with the volume of the total produced fluids from a producing well lifted to and handled at the ground surface. A reduction in the volume of produced fluids lifted to and handled at the ground surface results in a lowering of the horsepower required to operate the well since only produced hydrocarbons and a small fraction of produced water are actually lifted to the ground surface. Similarly, water injection costs, water treatment costs, spill containment costs, water transportation costs, and environmental cleanup costs may be substantially reduced by use of the present invention.

The present invention may also increase revenues from oil-producing wells. Use of dual injection and lifting systems such as the present invention, as opposed to use of conventional lift systems (which produce all fluids to surface) can increase production rates of producing wells. This increases operating revenues which can lead to an extended economic life of the well. Moreover, wells which previously were not operating due to high water volumes may be returned to production.

The present invention may also reduce investment costs for surface equipment. Moreover, separation equipment, treating equipment, and filtration equipment may be eliminated or reduced in size.

The present invention may also reduce exposure of the environment to damage from oil-producing operations. Potential environmental damages may be lessened by minimizing the amount of water produced to, and handled at, the surface. As known in the art, such surface water must then be reinjected into the subterranean strata through separate wellbores, or "injection wells." The very act of constructing facilities or drilling injection wells disturb the natural environment.

The present invention also provides a simple and effective method for handling high viscosity oils or solids, such as sand, which are present in many production wells. In addition, many wells which have become inoperative due to the inability of conventional systems to handle crude oil and gas mixtures or shear sensitive fluids may be returned to production. The present invention also allows compensation for changes in pressure, such as those that may be caused by gas bubbles.

Additional features and advantages of the invention will be set forth in the description that follows, and in part will be apparent from the description, or may be learned in practice of the invention. These descriptions and drawings are intended as illustrative of the invention, and not as limitative thereof.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiments of this invention are shown in some detail, although it will be apparent to those skilled in the relevant art that some features which are not relevant to the invention may not be shown for the sake of clarity.

Figure 1:
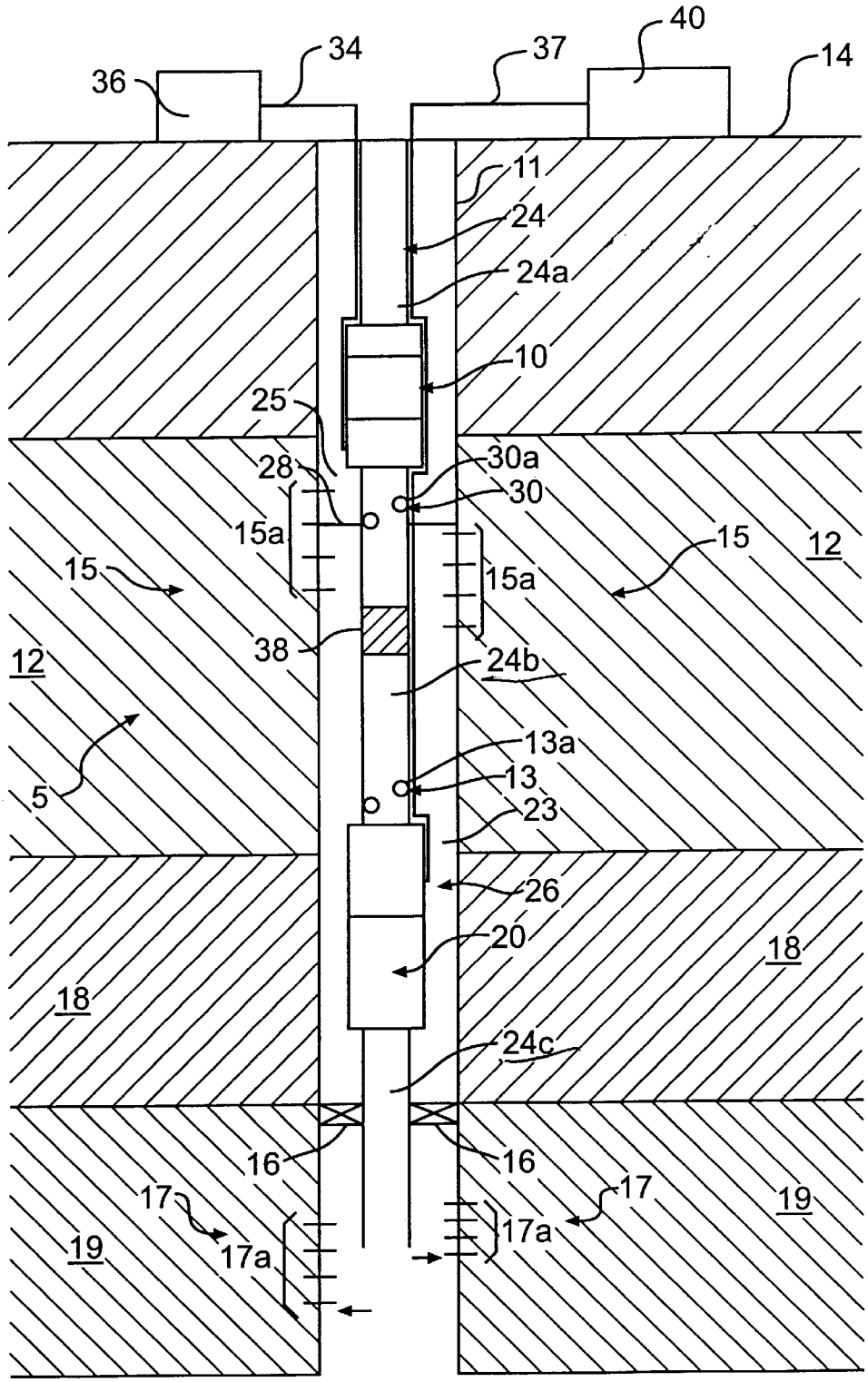
FIG. 1 is a schematic side-elevation sectional view of an exemplary embodiment of the present invention.

Referring first to FIG. 1, there is illustrated, in a schematic side-elevation sectional view, an exemplary embodiment of the present invention and is represented generally by reference numeral 5. A casing 11 is shown extending from a ground surface 14 downwardly within a subterranean well through a hydrocarbon and water producing zone 12 and then to a water injection zone 19. It should be understood by one of ordinary skill in the art that injection zone 19 may alternatively be referred to as a disposal zone. It is preferable to have a long distance or an isolation zone 18 between producing zone 12 and injection zone 19.

As shown in FIG. 1, casing 11 has a producing interval, shown generally at 15, separated from an injection interval, shown generally at 17. Producing interval 15 is located adjacent to and in fluid flow communication with producing zone 12. In a similar manner, injection interval 17 is located adjacent to and in fluid flow communication with disposal, or injection zone 19. Producing interval 15 may preferably be for example, but is not limited to, perforations 15*a* with or without gravel packs in casing 11 as shown in FIG. 1. Alternatively, producing interval 15 may be, but is not limited to, a slotted liner with or without gravel packs, wire-wrapped screens with or without gravel packs, or pre-packed wire-wrapped screens. Likewise, injection interval 17 may preferably be, but is not limited to, perforations 17*a* with or without gravel packs in casing 11 as shown in FIG. 1. As an alternative, injection interval 17 may be a slotted liner with or without gravel packs, wire-wrapped screens with or without gravel packs, or pre-packed wire-wrapped screens. As a further alternative, instead of using injection interval 17, the excess water may be injected directly into an open hole (not shown) within the subterranean strata. Preferably, however, injection interval 17 will be perforations 17*a*.

It should be readily apparent to one skilled in the art that casing 11 may be provided with multiple producing intervals 15 and injection intervals 17 in communication with producing zone 12 and injection zone 19, respectively. Moreover, injection zone 19 can be the same formation as producing zone 12 provided that producing interval 15 and injection interval 17 are not communicating actively (i.e., fluid flow is isolated between producing interval 15 and injection interval 17). It should be understood by those of skill in the art, however, that fluids produced into casing 11 through producing interval 15 and water injected through injection interval 17 may influence the flow parameters of each other.

Casing 11 surrounds a tubing 24 which extends from ground surface 14 downwardly within casing 11. Tubing 24 preferably includes three tubing sections, 24*a*, 24*b*, and 24*c*. It should be apparent to one of ordinary skill in the art that tubing 24 may include any number of tubing sections depending, of course, upon the particular configuration of the well.

A first pump 10 is disposed at an end of first tubing section 24*a* which extends from ground surface 14 downwardly within casing 11. Tubing section 24*b* extends between and is coupled to first pump 10 and a second pump 20. Second pump 20 is preferably disposed below first pump 10 in casing 11 on tubing 24, or more particularly, on second tubing section 24*b*. Tubing section 24*c* is coupled to second pump 20 and extends downwardly within casing 11 below a packer 16 disposed in casing 11.

First pump 10 and second pump 20 are shown in the embodiment of FIG. 1 uncoupled relative to each other. Particularly, first pump 10 is not drivingly coupled to second pump 20. First pump 10 and second pump 20 are preferably controlled by individual drives as will be described in more detail below. This configuration allows the individual pump rates to be separately controlled to respond to changing reservoir conditions. Moreover, individual rates of lift and injection can be separately controlled to optimize overall field performance.

In the embodiment shown in FIG. 1, first pump 10 is an electrical submersible progressive cavity pump (ESPCP) and second pump 20 is an electrical submersible pump (ESP). An electrical submersible centrifugal pump is particularly preferred. In an alternate embodiment of the present invention, first pump 10 is an ESP and second pump 20 is an ESPCP.

As noted above, packer 16 is disposed within casing 11, preferably between producing interval 15 and injection interval 17. Casing 11 and packer 16 are configured to permit produced hydrocarbons and produced water to collect above packer 16. By "produced hydrocarbons" is meant crude oil, gas, gas condensate, and various combinations thereof. Particularly, tubing 24, casing 11, and packer 16, together define casing/tubing annulus 26 that extends upward to ground surface 14. Hydrocarbons, such as oil or gas, and water flow or are "produced," into casing 11 through producing interval 15. The hydrocarbons and water segregate by gravity within casing/tubing annulus 26 forming a hydrocarbon/water interface 28. Gravity segregation, as used herein, is intended to describe the preservation of the isolation between produced hydrocarbons and water, as opposed to separation which indicates that a mixture is mechanically divided into separate fluids. Thus, the produced hydrocarbons and water are allowed to collect in annulus 26 above packer 16 and to segregate by gravity to form segregated produced water 23 below hydrocarbon/water interface 28 and segregated produced hydrocarbons and a small proportion or portion of produced water 25 above hydrocarbon/water interface 28.

A first, or upper inlet 30 is preferably disposed in tubing 24, or more particularly, in an upper end of tubing section 24*b*, below first pump 10. First inlet 30 is disposed in a region of casing 11, or more particularly, in a region of casing/tubing annulus 26, where segregated hydrocarbons and only a small proportion or portion of water are expected to be present and preferably, adjacent hydrocarbon/water interface 28. As shown in the exemplary embodiment in FIG. 1, first inlet 30 may be sets of perforations 30*a* in tubing 24. Alternatively, first inlet 30 may be a port or multiple ports or other suitable mechanisms for conducting fluid flow. Preferably, however, first inlet 30 will be sets of perforations 30*a*. First inlet 30 is configured to permit produced hydrocarbons and any portion of water that has not segregated from the hydrocarbons 25 to enter first pump 10. The operation of first inlet 30 will be described in more detail below.

A second, or lower inlet 13 is shown disposed in tubing 24, or more particularly, in a lower end of tubing section 24*b*, above second pump 20. Second inlet 13 is preferably disposed in a region of casing 11, or more particularly, in a region of casing/tubing annulus 26, where primarily only the heavier segregated produced water is present (i.e., inlet 13 is in fluid-flow communication primarily with segregated produced water 23). As shown in FIG. 1, second inlet 13 may be sets of perforations 13*a* in tubing 24 or second tubing section 24*b*. Second inlet 13 is configured to permit the segregated produced water from producing zone 12 to enter second pump 20 and to be injected into disposal zone 19 as will be discussed in more detail below. It may also be desirable, although not required, to dispose a tubing plug 38 in tubing 24, or more particularly second tubing section 24*b*, between first pump 10 and second pump 20, in order to maintain separation of the segregated produced hydrocarbons and a portion of the produced water 25 and the segregated produced water 23 within second tubing section 24*b*.

A first variable speed drive 36 may be disposed at ground surface 14 to provide power to and control the pump rate of first pump 10. First pump 10 is preferably coupled to first variable speed drive 36 by a first electrical line or cable 34. Similarly, a second variable speed drive 40 may be disposed at ground surface 14 to provide power to and control the pump rate of second pump 20. Second pump 20 is preferably coupled to second variable speed drive 40 by a second electrical line or cable 37.

Reference will now be made to the operation of the first exemplary embodiment shown in FIG. 1. In operation, produced fluids (hydrocarbons and water) are produced from producing zone 12 via intervals 15 into casing 11 above packer 16 forming a column of produced hydrocarbons and water within casing/tubing annulus 26. The lighter produced fluids (mostly hydrocarbons 25) rise to the top of the column while the heavier fluids (mostly water 23) settle to the bottom of the column.

Segregated hydrocarbons and a small portion of water 25 then flow, or are "pulled," through first inlet 30 and into tubing 24 below first pump 10. First pump 10 then pumps the segregated hydrocarbons and a small portion of water 25 (as will be described in more detail with reference to FIG. 4) through tubing 24 to ground surface 14 where it is collected in a well-known manner. It is preferred that, during production, hydrocarbon/water interface 28 is maintained adjacent first inlet 30 in order to provide stabilized pumping conditions. In order to meet the capacity of first pump 10 and to ensure that hydrocarbon/water interface 28 is maintained adjacent first inlet 30, an upper portion of segregated produced water 23 (in addition to produced hydrocarbons and portion of produced water 25) may be "pulled" by first pump 10 through first inlet 30 and pumped to ground surface 14.

Simultaneously, segregated produced water 23 that has settled at the bottom of the casing/tubing annulus 26 flows through second inlet 13 and into second pump 20. The segregated water is then pumped, or injected, through the end of tubing section 24*c* and into casing 11 below packer 16 and thereafter into injection zone 19.

It should be understood by one skilled in the art that first pump 10 and second pump 20 may include sensors (not shown) for flow rate, pressure, and temperature measurement or other types of control information which is transmitted to variable speed drives, 36 and 40. Thus, first pump 10 and second pump 20 are individually and independently controllable to provide maximum flexibility in selecting pump output to optimize reservoir performance and to allow conformance to changing reservoir conditions. Moreover, because first pump 10 and second pump 20 are separately controlled (i.e., first pump 10 is controlled by first variable speed drive 36 and second pump 20 is controlled by second variable speed drive 40), their respective pump output may be separately and independently varied to correspond to the changing reservoir conditions during production.

The entire combination of first pump 10 and second pump 20 may typically be about 30 feet to several hundred feet in length. Moreover, the distance from producing intervals 15 to packer 16, percentage of water cut and injection rate, and designed production rate can all be variables in deciding whether it is desirable to place second pump 20 just above packer 16 or higher in the well.

Figure 2:
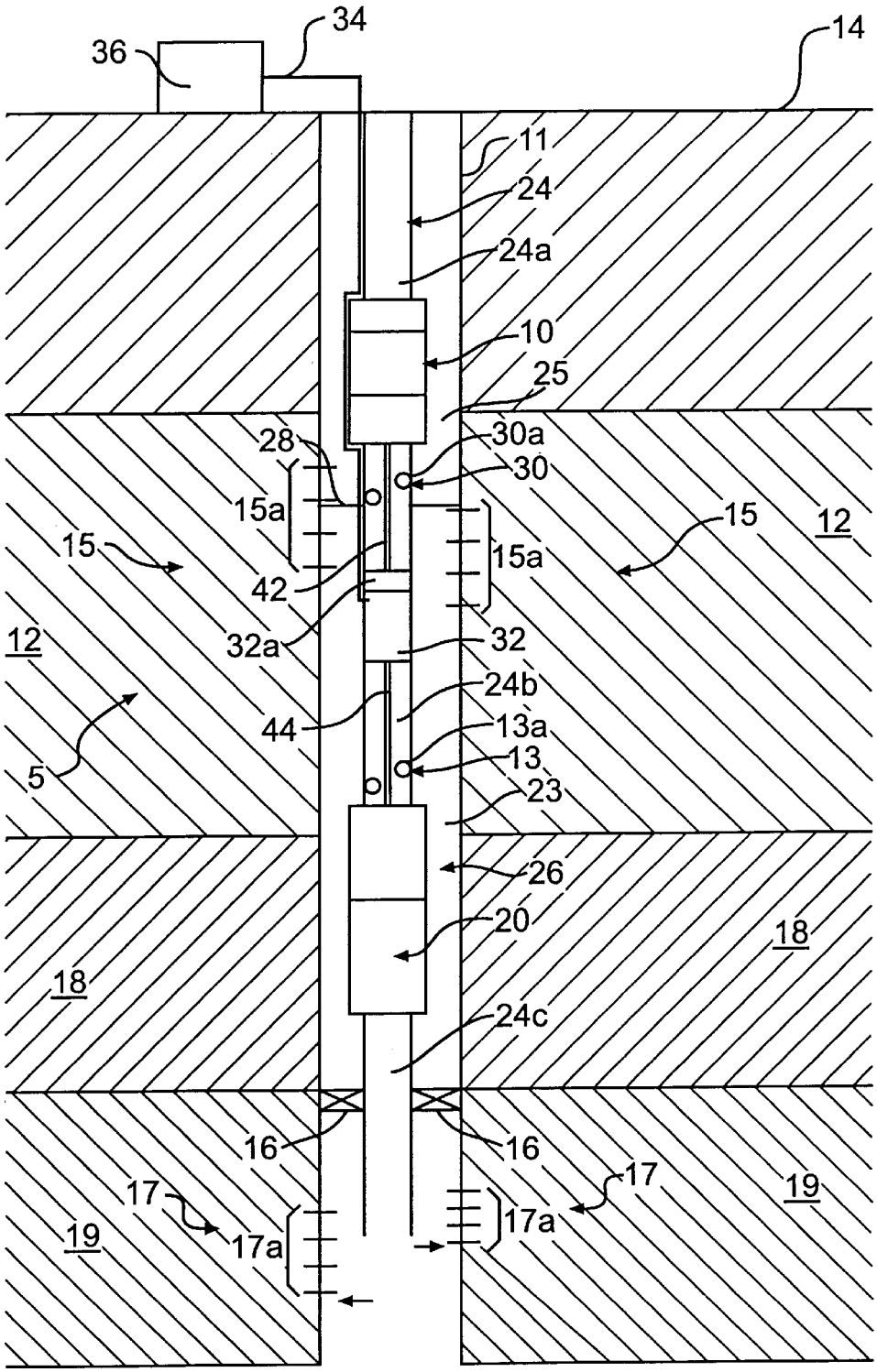
FIG. 2 is a schematic side-elevation sectional view of a second exemplary embodiment of the present invention.

Reference will now be made to FIG. 2, wherein a second embodiment of the present invention is shown employing a single submersible electric motor 32 to separately provide power to and control first pump 10 and second pump 20. Like reference numerals will be used where appropriate to describe similar elements to those of the embodiment shown in FIG. 1.

In FIG. 2, motor 32 is shown disposed in casing 11, and more particularly, in tubing section 24*b* between first pump 10 and second pump 20. Preferably, motor 32 will be axially aligned with first pump 10 and second pump 20. Motor 32 includes an upper drive shaft 42 coupled to first pump 10 through a gearbox 32*a*. Additionally, a lower drive shaft 44 is coupled between motor 32 and second pump 20.

Variable speed drive 36 is disposed at ground surface 14 to provide power to motor 32 and to control the output of motor 32 (e.g., speed of rotation). Motor 32 is preferably coupled to variable speed drive 36 by electrical line or cable 34. The remaining elements shown in FIG. 2 have been described above with reference to FIG. 1, and for the sake of brevity are herein incorporated by reference.

Reference will now be made to the operation of the second exemplary embodiment shown in FIG. 2. In operation, produced fluids (hydrocarbons and water) are produced from producing zone 12 via intervals 15 into casing 11 above packer 16 forming a column of produced hydrocarbons and water within casing/tubing annulus 26. The lighter produced fluids (mostly hydrocarbons) rise to the top of the column while the heavier fluids (mostly water) settle to the bottom of the column.

Segregated hydrocarbons and a small portion of water 25 then flow through first inlet 30 and into tubing 24 below first pump 10. First pump 10, driven by motor 32 via gearbox 32*a*, pumps the segregated hydrocarbons and small portion of water 25 through tubing 24 to the ground surface 14 where it is collected in a well-known manner.

Simultaneously, segregated produced water 23 which has settled at the bottom of casing/tubing annulus 26 flows through second inlet 13 and into second pump 20. The segregated water is then pumped, or injected through the end of tubing section 24*c* and into casing 11 below packer 16 and thereafter into injection zone 19.

Figure 3:
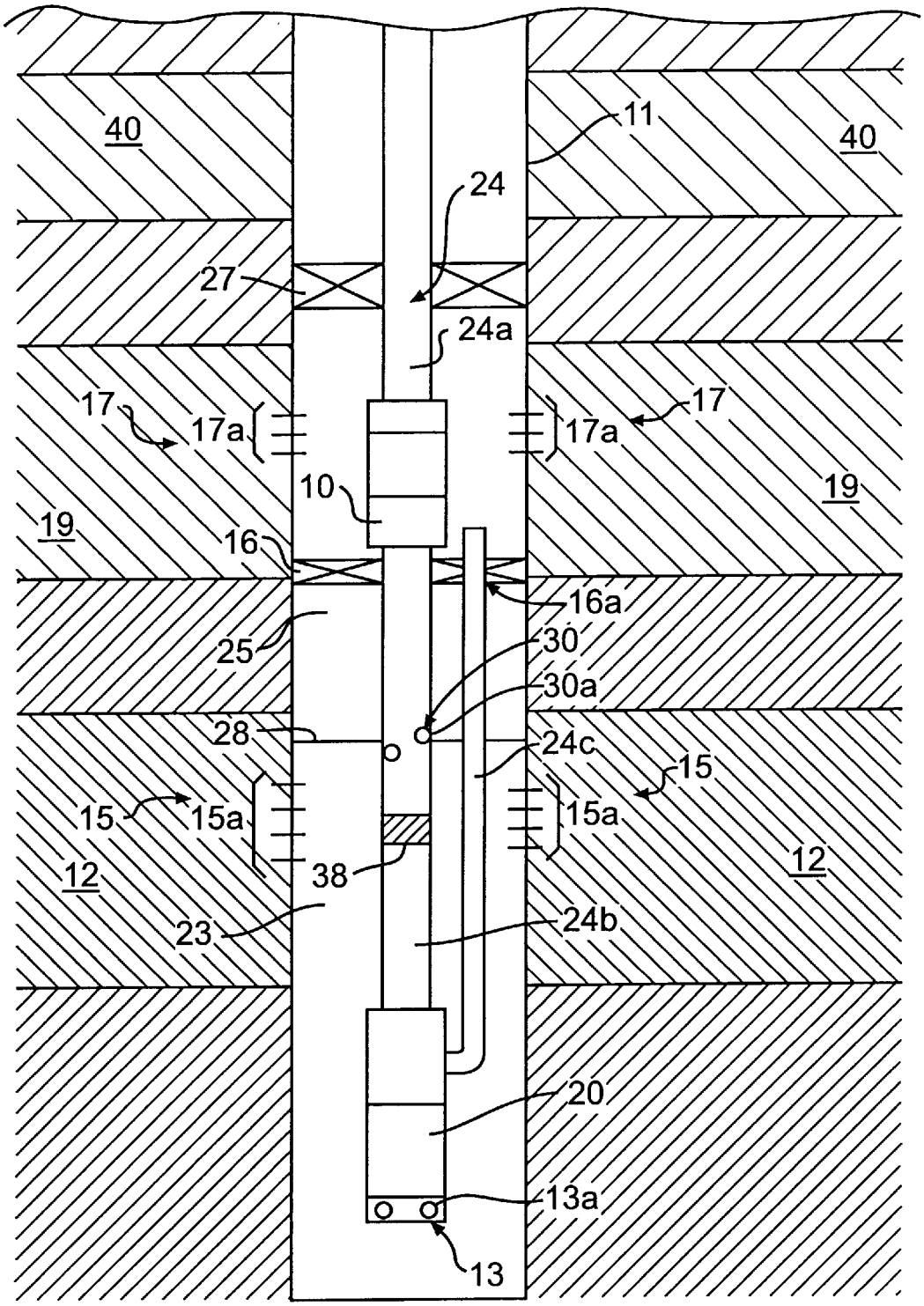
FIG. 3 is a schematic side-elevation sectional view of a third embodiment of the present invention shown with an injection zone overlying a producing zone in the subterranean reservoir.

Reference will now be made to FIG. 3, wherein a second embodiment of the present invention is shown in which third tubing section 24*c* is coupled to second pump 20 for injecting produced water into disposal zone 19 which is located above producing zone 12. In this embodiment, second pump 20 is preferably disposed at the end of tubing 24, or more particularly, at the end of second tubing section 24*b*.

As can be seen in FIG. 3, third tubing section 24*c* extends up casing/tubing annulus 26 and through a passage 16*a* in packer 16. A second packer 27 is disposed in casing 11 preferably above injection zone 19. Packer 16 and second packer 27 are configured to isolate injection zone 19 within casing 11 from both producing zone 12 and, for example, an isolated aquifer 40. Second inlet 13 is shown disposed on a lower end of second pump 20 such that segregated produced water 23 passing through second pump 20 may be used for cooling purposes.

Tubing plug 38 may be disposed in tubing 24, or more particularly in second tubing section 24*b*, between first pump 10 and second pump 20 in order to isolate segregated hydrocarbons and portion of produced water 25 from segregated produced water 23 within tubing 24.

During operation of the system shown in FIG. 3, first pump 10 lifts segregated produced hydrocarbons and a portion of produced water 25 to ground surface 14 in the manner described above. At the same time, second pump 20 pumps segregated produced water 23 that enters second pump 20 through second inlet 13 through third tubing section 24*c* and thereafter into disposal zone 19 via injection interval 17.

Figure 4:
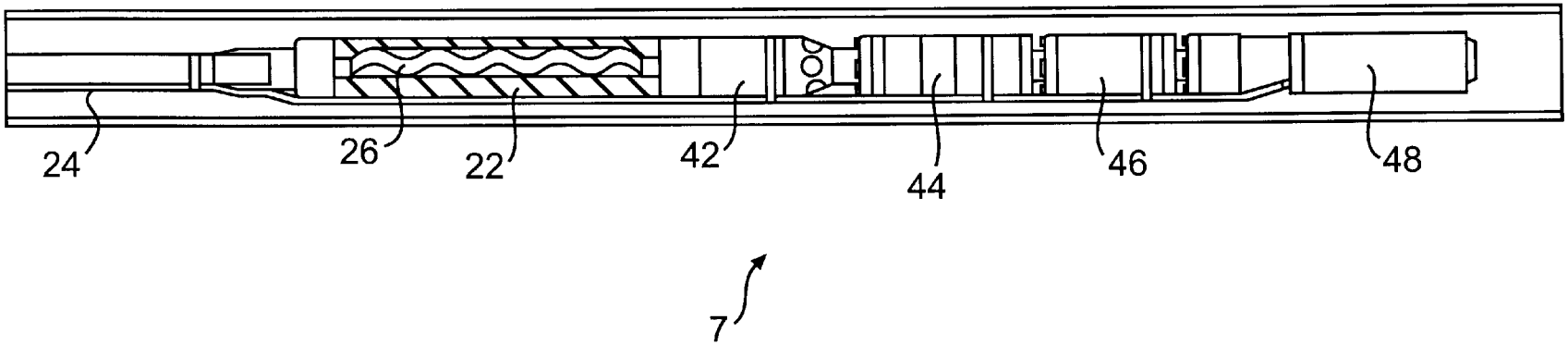
FIG. 4 is a schematic side-elevational view illustrating an exemplary electrical submersible progressive cavity pump suitable for use in the present invention.

Reference will now be made to FIG. 4, which is provided to illustrate a schematic partial view of an exemplary electrical submersible progressive cavity pump (ESPCP) suitable for use with the present invention, represented generally as reference numeral 7. An exemplary electrical submersible progressive cavity pump suitable for use with the present invention is shown in U.S. Pat. No. 3,677,665, the entirety of which is incorporated herein by reference. When used with the present invention, ESPCP 7 is preferably coupled to tubing 24 as described above, however, ESPCP 7 may also be disposed within tubing 24.

The ESPCP preferably comprises a helically shaped rotor 26 and a stator 22. Rotor 26, which is the ESPCP's only moving part, is usually in the shape of a single external helix with a round cross section. Rotor 26 is normally plated with a hardened surface coating for abrasion resistance in the presence of sand, formation residue chips, or the like. Stator 22 is generally formed of a very firm, but elastomeric compound (such as synthetic rubber) and usually has a double internal helix. Its external shape is generally cylindrical and therefore provides a surface which may be bonded to a pump body. Rotor 26 is suspended in stator 22 and may be powered (i.e., rotated) by an electrical submersible motor 48 via a gear reduction drive 46 which is used preferably as a conventional speed reducer. A flex shaft 42 and a seal section 44 are coupled together and located between rotor 26 and gear reduction drive 46.

In operation, as internal helical pump rotor 26 is turned by motor 48, a series of cavities are formed between the helices of rotor 26 and stator 22 beginning at the intake end and progressing, with the rotary motion, to the output end. The progressive cavities cause fluid to be pumped from the input end to the output end. If rotor 26 is chosen to have a right hand pitch helix, then a vertical pump placed in a well will input fluid into its lower end 29 and output fluid from its upper end 31 with right hand rotation. Conversely, if rotor 26 is chosen to have a left hand pitch helix, then a vertical pump placed in a well will input fluid from its upper end 31 and output the fluid from its lower end 29.

The ESPCP is highly efficient when compared to other oil field pumps in common usage. For example, a typical electrical-powered submersible centrifugal pump is from about 25% to 45% efficient. A hydraulic jet pump usually runs from about 15% to 30% efficient. Sucker rod powered mechanical pumps generally run from about 45% to 50% efficient. Conversely, ESPCP's usually run from about 70% to 95% efficient. The ESPCP can also handle solids or very heavy crude oil where more delicate electric pump impellers, electric motors or gearboxes on sucker rod pumping units fail. While a hydraulic jet pump can efficiently operate in high solids environment, its operating efficiency is only about one third of the ESPCP. ESPCP's that are commercially available can operate at production rates of up to 5,200 barrels of fluid per day from shallow wells. ESPCP's are capable of operating at depths up to about 5,000 feet, with fluid density from 6 to 45 American Petroleum Institute (API) degrees gravity, at temperatures up to 300° F./150° C. and in salty, sandy and high viscosity fluids. However, at such depths the volume of fluid produced would be less than producing from shallow wells.

As described above, the present invention provides a simple method and apparatus for providing flexibility and reliability in lifting produced hydrocarbons and only a portion of the produced water to the ground surface while simultaneously injecting excess produced water subsurface. It should be apparent that the present invention may be used to increase efficiency and production, to lower production, injection, and equipment costs, and to extend the overall commercial life of hydrocarbon producing fields.

Moreover, the present invention significantly reduces the disturbance to and impact on the natural environment while improving the economics of hydrocarbon recovery. The apparatus and method of the present invention reduces the amount of land disturbance, such as less earthwork, erosion, and spills. In addition, the present invention reduces the amount of surface facilities required such as tanks, separators, and surface handling equipment. With less and/or smaller surface equipment, there would be fewer leaking valves and connections as well as reduced chemical handling, storage, and use. Through use of the present invention, fewer single-use injection wells and associated facilities, pumps, and injection lines are needed. The present invention can also reduce the need for produced water trucking or transportation. Further, because less water is lifted to the ground surface, the evaporation and exposure of water-soluble hydrocarbons to the atmosphere is minimized. In reservoirs wherein the excess water has a moderate to high hydrogen sulfide content, exposure of the hydrogen sulfide to the surrounding environment may also be minimized or eliminated. Moreover, with less equipment at the ground surface, noise or other air pollution from such equipment may be minimized. Waterfloods or pressure maintenance projects could utilize less fresh water. Fewer spills from corrosion, overflowing tanks, or other equipment failures are other benefits. Further, there is less need for isolated wastewater disposal sites and fewer wellbores penetrating aquifers. Smaller offshore platforms are possible as well.

The present invention can also result in less electrical power and associated costs which allows for more efficient recovery of natural hydrocarbon resources and extended life for marginal wells and fields. The present invention could also provide pressure maintenance or waterflooding as a byproduct of production.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

We claim:

1. An apparatus for selectively lifting produced fluids, including produced liquid hydrocarbons and a portion of produced water, to a ground surface and injecting, without lifting to the ground surface, the remaining produced water below the ground surface, the apparatus comprising:

a casing having two spaced intervals and extending from the ground surface downwardly such that a first of said two spaced intervals communicates with a producing zone so that produced liquid hydrocarbons and produced water enter said casing through said first of said two spaced intervals and a second of said two spaced intervals communicates with an injection zone;

an electrical submersible progressive cavity pump and an electrical submersible pump disposed in said casing;

a packer disposed within said casing between said first of said two spaced intervals and said second of said two spaced intervals, wherein said casing and said packer are configured to permit the produced fluids to collect above said packer whereby the produced liquid hydrocarbons and produced water segregate under influence of gravity;

a first inlet for permitting the segregated produced liquid hydrocarbons and portion of the produced water to enter one of said electrical submersible progressive cavity pump and said electrical submersible pump;

a second inlet for permitting the segregated produced water to enter the other of said electrical submersible progressive cavity pump and said electrical submersible pump; and a tubing extending from the ground surface downwardly within said casing, said tubing comprising a first tubing section, a second tubing section, and a third tubing section, wherein said first tubing section extends from the ground surface downwardly within said casing and is coupled to said one of said electrical submersible progressive cavity pump and said electrical submersible pump, said second tubing section extending between and coupled to said electrical submersible progressive cavity pump and said electrical submersible pump, and said third tubing section coupled to said one of said electrical submersible progressive cavity pump and said electrical submersible pump, and wherein said first inlet is disposed in said tubing below said one of said electrical submersible progressive cavity pump and said electrical submersible pump and is in fluid flow communication therewith and said second inlet is disposed in said tubing above said one of said electrical submersible progressive cavity pump and said electrical submersible pump and is in fluid flow communication therewith.

2. An apparatus according to claim 1, wherein said first tubing section extends from the ground surface downwardly within said casing and is coupled to said electrical submersible progressive cavity pump, said second tubing section extends between and is coupled to said electrical submersible progressive cavity pump and said electrical submersible pump, and said third tubing section is coupled to said electrical submersible pump.

3. An apparatus according to claim 2, wherein said first inlet is disposed in said tubing below said electrical submersible progressive cavity pump and is in fluid flow communication therewith and said second inlet is disposed in said tubing above said electrical submersible pump and is in fluid flow communication therewith.

4. An apparatus according to claim 2, wherein said third tubing section extends downwardly below said packer in said casing.

5. An apparatus according to claim 2, further comprising:

a second packer disposed in said casing, wherein said packer and said second packer are configured to isolate an injection zone located above the producing zone.

6. An apparatus according to claim 5, wherein said third tubing section extends upwardly through said casing and said packer thereby providing a flow path for the segregated produced water into said casing between said packer and said second packer and thereafter into the injection zone.

7. An apparatus according to claim 2, further comprising:

a tubing plug disposed in said tubing between said electrical submersible progressive cavity pump and said electrical submersible pump.

8. An apparatus according to claim 1, wherein said first tubing section extends from the ground surface downwardly within said casing and is coupled to said electrical submersible pump, said second tubing section extends between and is coupled to said electrical submersible pump and said electrical submersible progressive cavity pump, and said third tubing section is coupled to said electrical submersible progressive cavity pump.

9. An apparatus according to claim 8, wherein said first inlet is disposed in said tubing below said electrical submersible pump and is in fluid flow communication therewith and said second inlet is disposed in said tubing above said electrical submersible progressive cavity pump and is in fluid flow communication therewith.

10. An apparatus according to claim 8, wherein said third tubing section extends downwardly below said packer in said casing.

11. An apparatus according to claim 8, further comprising:

a second packer disposed in said casing, wherein said packer and said second packer are configured to isolate an injection zone located above the producing zone.

12. An apparatus according to claim 11, wherein said third tubing section extends upwardly through said casing and said packer thereby providing a flow path for the segregated produced water into said casing between said packer and said second packer and thereafter into the injection zone.

13. An apparatus according to claim 8, further comprising:

a tubing plug disposed in said tubing between said electrical submersible progressive cavity pump and said electrical submersible pump.

14. An apparatus according to claim 1, further comprising:

a first variable speed drive coupled to said electrical submersible progressive cavity pump for controlling the output of said electrical submersible progressive cavity pump.

15. An apparatus according to claim 14, further comprising:

a second variable speed drive coupled to said electrical submersible pump for controlling the output of said electrical submersible pump.

16. An apparatus according to claim 1, further comprising:

a submersible electrical motor disposed within said casing, said motor coupled to said electrical submersible progressive cavity pump and to said electrical submersible pump.

17. An apparatus according to claim 16, further comprising a variable speed drive coupled to said submersible electrical motor for controlling the output of said motor.

18. An apparatus according to claim 17, further comprising:

a gearbox coupled to said motor and said electrical submersible progressive cavity pump.

19. An apparatus according to claim 1, further comprising:

means for independently controlling the output of said electrical submersible progressive cavity pump and said electrical submersible pump.

20. An apparatus according to claim 19, wherein said means for independently controlling comprises a variable speed drive.

21. An apparatus according to claim 20, wherein said means for independently controlling further comprises a motor.

22. A downhole oil and water separation system for conducting produced fluids, including produced liquid hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone so that produced liquid hydrocarbons and produced water enter said casing through said first of said two spaced intervals and a second of said two spaced intervals communicates with an injection zone;

an electrical submersible progressive cavity pump and an electrical submersible pump disposed in said casing, wherein said electrical submersible progressive cavity pump is not drivingly coupled to said electrical submersible pump;

a packer disposed within said casing between said first of said two spaced intervals and said second of said two spaced intervals, wherein said casing and said packer are configured to permit the produced fluids to collect above said packer whereby the produced liquid hydrocarbons and produced water segregate under influence of gravity;

a first inlet for permitting the segregated produced liquid hydrocarbons and portion of the produced water to enter said electrical submersible progressive cavity pump;

a second inlet for permitting the segregated produced water to enter said electrical submersible pump; and a tubing extending from the ground surface downwardly within said casing, said tubing comprising a first tubing section, a second tubing section, and a third tubing section, wherein said first tubing section extends from the ground surface downwardly within said casing and is coupled to said electrical submersible progressive cavity pump, said second tubing section extending between and coupled to said electrical submersible progressive cavity pump and said electrical submersible pump, and said third tubing section coupled to said electrical submersible pump, and wherein said first inlet is disposed in said tubing below said electrical submersible progressive cavity pump and is in fluid flow communication therewith and said second inlet is disposed in said tubing above said electrical submersible pump and is in fluid flow communication therewith.

23. A downhole oil and water separation system for conducting produced fluids, including produced liquid hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone so that produced liquid hydrocarbons and produced water enter said casino through said first of said two spaced intervals and a second of said two spaced intervals communicates with an injection zone;

an electrical submersible progressive cavity pump and an electrical submersible pump disposed in said casing, wherein said electrical submersible progressive cavity pump is not drivingly coupled to said electrical submersible pump;

a packer disposed within said casing between said first of said two spaced intervals and said second of said two spaced intervals, wherein said casing and said packer are configured to permit the produced fluids to collect above said packer whereby the produced liquid hydrocarbons and produced water segregate under influence of gravity;

a first inlet for permitting the segregated produced liquid hydrocarbons and portion of the produced water to enter said electrical submersible pump;

a second inlet for permitting the segregated produced water to enter said electrical submersible progressive cavity pump; and a tubing extending from the ground surface downwardly within said casing, said tubing comprising a first tubing section, a second tubing section, and a third tubing section, wherein said first tubing section extends from the ground surface downwardly within said casing and is coupled to said electrical submersible pump, said second tubing section extending between and coupled to said electrical submersible progressive cavity pump and said electrical submersible pump, and said third tubing section coupled to said electrical submersible progressive cavity pump, and wherein said first inlet is disposed in said tubing below said electrical submersible pump and is in fluid flow communication therewith and said second inlet is disposed in said tubing above said electrical submersible progressive cavity pump and is in fluid flow communication therewith.

* * * * *